US012480249B1

(12) United States Patent
Zhang

(10) Patent No.: US 12,480,249 B1
(45) Date of Patent: Nov. 25, 2025

(54) WIDE VOLTAGE STEAM ELECTRIC IRON

(71) Applicant: Gensheng Zhang, Hefei (CN)

(72) Inventor: Gensheng Zhang, Hefei (CN)

( * ) Notice: Subject to any disclaimer, the term of this patent is extended or adjusted under 35 U.S.C. 154(b) by 0 days.

(21) Appl. No.: 18/975,679

(22) Filed: Dec. 10, 2024

(51) Int. Cl.
*D06F 73/00* (2006.01)

(52) U.S. Cl.
CPC ..... *D06F 73/00* (2013.01)

(58) Field of Classification Search
CPC ..... D06F 73/00; D06F 75/10; D06F 75/20; D06F 87/00
See application file for complete search history.

(56) References Cited

U.S. PATENT DOCUMENTS 3,742,629 A * 7/1973 Plasko ..... D06F 87/00 392/404
11,560,665 B2 * 1/2023 Leung ..... G05D 9/02
11,629,453 B2 * 4/2023 Lai ..... D06F 73/00 68/5 A
11,761,146 B2 * 9/2023 Sibeaud ..... D06F 75/24 38/77.1
12,152,337 B2 * 11/2024 Yu ..... D06F 75/20
12,180,646 B2 * 12/2024 Yu ..... D06F 87/00
2024/0093423 A1 * 3/2024 Gray ..... A47L 25/00
2025/0003141 A1 * 1/2025 Fang ..... D06F 73/00
2025/0188674 A1 * 6/2025 Ren ..... D06F 75/24

* cited by examiner

*Primary Examiner* — F Griffin Hall
(74) *Attorney, Agent, or Firm* — Birchwood IP

(57) ABSTRACT

The Invention provides a wide voltage steam electric iron, which relates to the field of steam electric irons. The wide voltage steam electric iron includes a water tank whose top is provided with a left rotating shaft casing and a right shaft casing; the said left rotating shaft casing and the said right rotating shaft casing are interlocked; there is a rotating shaft between the said left rotating shaft casing and the said right rotating shaft casing; the surface of the rotating shaft is rotatably connected to the right casing body and the left casing body. When the power switch of the wide voltage steam electric iron is turned on, a voltage is input into a detection module.

4 Claims, 1 Drawing Sheet

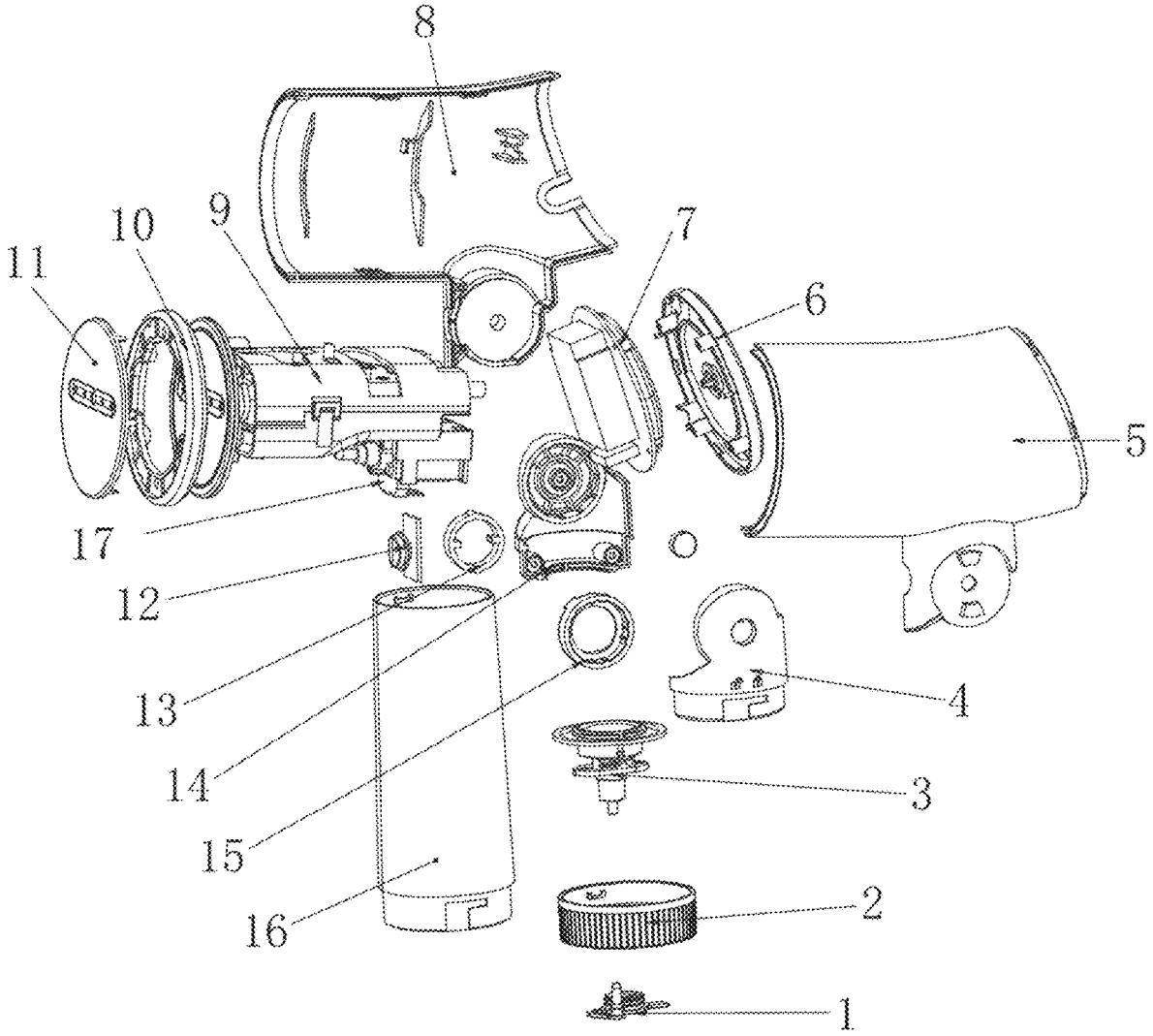
8
10
9
7
11
6
5
17
12
13
4
14
3
15
16
2
1

WIDE VOLTAGE STEAM ELECTRIC IRON

TECHNICAL FIELD

The Invention relates to the field of steam electric iron technology and is specifically a wide voltage steam electric iron.

BACKGROUND

Two-phase high voltage is divided into 240V and 110V in different countries worldwide. Household appliances, when moved from one country to another country, may not be adaptive due to different voltages. The wide voltage steam electric iron can adapt to most voltages. However, currently available steam electric irons lack space for water storage, and they are also inconvenient to clean and maintain, and their handles can't be folded, thus affecting the using effect.

SUMMARY

The purpose of the Invention is to provide a wide voltage steam electric iron for solving the problems identified in the above background of the Invention.

Technical Scheme

For the above purpose, the Invention offers the following technical scheme: a wide voltage steam electric iron includes a water tank, whose top is provided with a left rotating shaft casing and a right rotating shaft casing, wherein the said left rotating shaft casing and the said right rotating shaft casing are interlocked; there is a rotating shaft between the said left rotating shaft casing and the said right rotating shaft casing; the surface of the said rotating shaft is rotatably connected to the right casing body and the left casing body; the said right casing body and the left casing body are interlocked; the said right casing body and the said left casing body are internally provided with a aluminum alloy heating cavity; the right side of the said heating cavity is provided with a PCB for main unit; the right side of the said PCB for main unit is provided with a clear lamp and a power source rear cover; the said clear lamp and the power source rear cover are interlocked on the right side of the right casing body and the left casing body; the upper part of the said water tank is provided with a steam knob; the right side of the said steam knob is provided with a damper valve; the surface of the said damper valve is provided with a damper ring; the left side of the said heating cavity is provided with a panel cover; the left side of the said panel cover is provided with a aluminum alloy perforated panel; the bottom of the said water tank is provided with a water tank cover; the said water tank is internally provided with a water suction valve; the bottom of the said water tank cover and a silicone cover for water injection are interlocked.

Furthermore, the said PCB for main unit is connected to an external power source.

Furthermore, the said PCB for main unit is provided with a voltage detection module; the said voltage detection module receives power-on detection signal according to the power source signal of the engaged switch; the said detection signal is transmitted to polycrystalline silicon; the said polycrystalline silicon undergoes rectification; the said post-rectification stable voltage is available at a specific rated value; the actual numerical signal of voltage is output; with respect to the said signal, rated voltage and wave mode are adjusted and output through a controllable module.

Furthermore, the said rated voltage and wave mode output stable signal; the said output stable signal is transmitted to a chip and PCB for controlling the water pump, a heating cavity and a resistance wire.

The Invention provides a wide voltage steam electric iron. It produces the following beneficial effects:

1. When the power switch of the wide voltage steam electric iron is turned on, a voltage is input into a detection module which receives power-on detection signal. After rectification, the actual magnitude of input voltage is detected; voltage and wave mode are adjusted and output through a controllable module and then transmitted to a chip for controlling a water pump, aluminum alloy (with a built-in heating resistance wire), electronic elements on PCB; a aluminum alloy heating cavity can contain water and steam; with the technology of the invention patent, the steam electric iron, as a household appliance, works in a state in which the equivalent power is constant at 1,000 W and voltage is always stable within a certain range (80V~260V).

In the wide voltage steam electric iron, the handle is provided with a space for water storage; a water suction valve is available for cleaning the water tank; the handle can perform the function of water storage; the upper and lower ends are sealed; its bottom and a silicone cover for water injection are interlocked; opening the silicone cover can enable water injection; closing it can enable water plugging and prevent leaks; such prevention is based on silicone's elastic function; water suction relies on suction valve which has built-in elastic silicone; spring and steel ball are available; the foldable handle body and the water suction and storage handle are provided with a rotatable device which is integrated with a rotating lock; the water tank can be removed by rotation; with rotating lock integration, the foldable handle body is provided with a water pipe; the water pipe relies on the rotating lock to press the spring within the water suction valve; its water passage is smooth; The bottom cover of the water tank can be cleaned and rinsed; the bottom cover of the water tank is provided with a structure which can be locked and opened by rotation; the end face of the bottom cover of the water tank is provided with a closed silicone cover, resulting in a closed space. In order to clean and rinse the water tank, the water tank's cover is opened by rotation, showing the space of the water tank's inner wall, making it convenient for cleaning.

BRIEF DESCRIPTION OF DRAWINGS

FIG. 1 shows the structural diagram of the Invention.

Where, 1 Silicone cover for water injection; 2 Water tank cover; 3 Water suction valve; 4 Left rotating shaft casing; 5 Left casing body; 6 Clear lamp and power source rear cover; 7 PCB for main unit; 8 Right casing body; 9 Heating cavity; 10 Panel cover; 11 Aluminum alloy perforated panel; 12 Steam knob; 13 Damper valve; 14 Right rotating shaft casing; 15 Damper ring; 16 Water tank; 17 Water pump.

DESCRIPTION OF EMBODIMENTS

As shown in FIG. 1, the embodiments of the Invention provide a wide voltage steam electric iron, including a water tank 16, whose top is provided with a left rotating shaft casing 4 and a right rotating shaft casing 14, wherein the left rotating shaft casing and the right rotating shaft casing are interlocked; there is a rotating shaft between the left rotating shaft casing and the right rotating shaft casing; the surface of the rotating shaft is rotatably connected to the right casing body and the left casing body; the right casing body and the left casing body are interlocked; the right casing body 8 and the left casing body 5 are internally provided with an aluminum alloy heating cavity 9; the right side of the heating cavity 9 is provided with a PCB 7 for main unit; the PCB 7 for main unit is connected to an external power source; the right side of the PCB 7 for main unit is provided with a clear lamp and a power source rear cover 6; the clear lamp and the power source rear cover 6 are interlocked on the right side of the right casing body 8 and the left casing body 5; the upper part of the water tank 16 is provided with a steam knob 12; the right side of the steam knob 12 is provided with a damper valve 13; the surface of the damper valve 13 is provided with a damper ring 15; the left side of the heating cavity 9 is provided with a panel cover 10; the left side of the panel cover 10 is provided with a aluminum alloy perforated panel 11; the bottom of the water tank 16 is provided with a water tank cover 2; the water tank 16 is internally provided with a water suction valve 3; the bottom of the said water tank cover 2 and a silicone cover 1 for water injection are interlocked.

The Invention Patent focuses on completing work on a circuit control board, with power connection based on resistance wire, and involves invention of a voltage detection module. The voltage detection module receives power-on detection signal according to the power source signal of the engaged switch; the detection signal is transmitted to polycrystalline silicon; the polycrystalline silicon undergoes rectification; the post-rectification stable voltage is available at a specific rated value; the actual numerical signal of voltage is output; with respect to the signal, rated voltage and wave mode are adjusted and output through a controllable module; wave mode outputs stable signal to be transmitted to a chip and PCB for controlling the water pump 17, a heating cavity 9 and a resistance wire; a heating module always obtains voltage within a certain range (80V~260V) to be delivered to a resistance wire with rated power as the heating cavity, while the resistance wire with rated power is heated at full power; as the resistance wire is heated, heat conduction is enabled. Heat conduction is based on aluminum with a heat conductivity coefficient of **237 W/(m·K); as aluminum is a metal material, aluminum enjoys high heat conductivity. When water flows through its surface, it will immediately absorb heat, and delivers it to the surrounding air, thus the heat conductivity coefficient of aluminum is very high; the aluminum alloy heating cavity instantly leverages high heat conductivity of aluminum alloy; water is delivered by water pump to the heating cavity before becoming vapor; as liquid water, whose heat conductivity coefficient is approximately 0.59 W/(m·K), is attached to the surface of the aluminum alloy heating cavity, such water changes from the liquid state to the gaseous state. Vaporization of liquid water represents physical changes: as water changes from the liquid state to the gaseous state, vaporization occurs, the volume expands and the spacing between water molecules changes (increases). The principle of water evaporation is as follows: when the heating cavity is heated, individual water molecules have different molecular kinetic energy at different temperatures (in other words, mean molecular kinetic energy is different), which features a distribution; there are high and low molecular velocities; if high-velocity molecules are on the surface, they may shake off intermolecular forces and run outside, resulting in evaporation, while such evaporation could occur at a very low temperature. As the heating cavity experiences temperature rise in a power-on state, with increasing temperature, mean molecular kinetic energy increases, high-velocity molecules make up a large proportion, so evaporation becomes more and more obvious; at the boiling point, a great deal of bubbles evaporated within molecules can arrive at the surface and evaporate, giving rise to violent evaporation and subsequent boiling.

The heating cavity is provided with a temperature sensing pipe which detects temperature on a real-time basis; the detected temperature is transferred to the chip which controls the flow of water into the pump and the heating time; intelligent computation and control are enabled; chip-based intelligent bilateral control is exercised. When eat energy is greater than the energy absorbed during water vaporization, in other words, there is no excess liquid water, within the heating cavity, that has not yet be vaporized, it is impossible that water spraying occurs, there is good safety. PCB for main unit is fixed at the lamp's transparent mirror; power key casing and rear cover plate are connected with set-screws; the said module is placed on PCB; PCB for main unit is connected to an external power source. Water pump has ports connected to PCB for main unit and steam key+circuit board, respectively; steam key controls water supply for water pump; once steam key is pressed, water pump pumps water; once steam key is pressed again, water pump stops water; two ports, of water pump, for inlet and exit channels are connected to water pipes; the water inlet end is connected to one end of water diversion pipe, another end of which is connected to water tank's bottom; water tank can be removed by rotation; the removed water tank is internally provided with a water valve which enables unidirectional water supply; as the water valve is installed, opening is effected; as it is removed, closing and water plugging are effected; the inner end of the water valve is connected to water diversion pipe; another end of water diversion pipe is fixed on water tank's bottom; water diversion pipe on water tank's bottom passes through water valve; another end of water valve is connected to water diversion pipe; one end of water diversion pipe is connected to the connecting inlet port of water pump, while another end is connected to the water inlet of heating cavity, and it passes a radiating body; a radiating fin delivers the preheated water from the radiating body to the heating cavity 9 for conversion of thermal energy, in which case, water becomes water vapor; water vapor is exported from the corresponding hole on the electric appliance's ironing board via the outlet in the front of the heating cavity.

When water pump receives signal, press steam key, start water pump; water is delivered, via the water diversion pipe (with a built-in stainless steel spring), to water pump's input port and then water pump for pressurizing; after pressurizing, water comes out of water pump's output port connected to the water diversion pipe, while the water diversion pipe passes the radiating fin connected to PCB crystalline silicon board.

The radiating fin consists of aluminum alloy upper, lower covers+water diversion pipe+cold water circulation. The lower cover has an embedded circular ring type U channel in which the water diversion pipe is placed; the upper, lower covers and the water diversion pipe are fixed with screws to constitute the radiating fin. The water diversion pipe transmits and absorbs the heat from the working polycrystalline silicon board; as cold water flows in the water diversion pipe, temperature decreases; ultimately, the water diversion pipe injects water into the heating cavity.

The heating cavity 9 consists of aluminum alloy (with a built-in heating resistance wire) and multiple inner cavities separated by stiffening ribs, in which case, inner cavities are provided with a cover plate and a silicone sheet for constituting a closed loop space and the outside of cavities features power supply terminal, vent hole, temperature detector, overload fuse, jump temperature-controlled switch and neutral line port etc. The upper cover plate has a water inlet port; a closed-loop enclosed space is a site where energy conversion occurs and water changes to vapor. For electric energy power, the following principle governs: as the resistance wire is electrified, heat is generated to enable physical changes in water under high voltage, so electric heat energy is converted into steam energy. With insertion of power line, power button is pressed; water is delivered, by a water pump which can control water flow, to the heating aluminum alloy body in which temperature increases and liquid water is changed by heat conduction to water vapor, which undergoes a three-stage pressurization mechanism and ejected at a high speed through the hole on the ironing panel, in which case, steam is in a state of high speed and high temperature and used for ironing and pressing clothing. Thus, a portable wide voltage steam iron emerges.

The heating cavity 9 has a built-in temperature detector connected to PCB 7 for main unit; the temperature detector detects temperature on a real-time basis and transfers temperature to IC on PCB 7 for main unit; IC connects switch power signal according to the voltage detection module; signal is fed back to the resistance wire of the heating cavity, while such resistance wire is heated at stable voltage in a zone; control signal is bidirectionally transmitted between heating and temperature detector.

The handle features multiple different folding angles; damper valve 13 has damper ring 15; concave and convex are arranged and interact within an integrated space, giving rise to folding angles.

The handle has a water tank with a space for water storage. The water tank can be cleaned and rinsed. The handle performs the water storage function; the upper and lower ends are sealed; its bottom and silicone cover 1 for water injection are interlocked; opening the silicone cover can enable water injection; once the silicone cover 1 for water injection is closed, water plugging is enabled to prevent leaks; such prevention is based on silicone's elastic function; water suction relies on suction valve 3 which has built-in elastic silicone; spring and steel ball are integrated.

The foldable handle body, water suction and storage handle are provided with a rotatable device which is integrated with a rotating lock; water tank 16 can be removed by rotation. The foldable handle body is provided with a water funnel which relies on a rotating lock to press the spring within the suction valve 3; its water passage is smooth. The bottom cover 2 of the water tank 16 can be cleaned; the bottom cover 2 of the water tank 16 is provided with a structure which can be locked and opened by rotation; the end face of the bottom cover 2 of the water tank 16 is provided with a closed silicone cover, resulting in a closed space. In order to clean and rinse the water tank, the water tank's cover 2 is opened by rotation, showing the space of the water tank 16's inner wall, making it convenient for cleaning.

What is claimed is:

1. A wide voltage steam electric iron, including a water tank, a top of the water tank is provided with a left rotating shaft casing and a right rotating shaft casing, wherein the left rotating shaft casing and the right rotating shaft casing are interlocked;

there is a rotating shaft between the left rotating shaft casing and the right rotating shaft casing; a surface of the rotating shaft is rotatably connected to a right casing body and a left casing body; the right casing body and the left casing body are interlocked; the right casing body and the left casing body are internally provided with a heating cavity;

a right side of the heating cavity is provided with a PCB;

a right side of the PCB is provided with a clear lamp and a power source rear cover; the clear lamp and the power source rear cover are interlocked on a right side of the right casing body and the left casing body;

an upper part of the water tank is provided with a steam knob; a right side of the steam knob is provided with a damper valve;

a surface of the damper valve is provided with a damper ring; a left side of the heating cavity is provided with a panel cover; a left side of the panel cover is provided with an aluminum alloy perforated panel;

a bottom of the water tank is provided with a water tank cover; the water tank is internally provided with a water suction valve; a bottom of the water tank cover and a silicone cover for water injection are interlocked.

2. The wide voltage steam electric iron according to claim 1, wherein the PCB is configured to be connected to an external power source.

3. The wide voltage steam electric iron according to claim 2, wherein the PCB is provided with a voltage detection module; the voltage detection module is configured to receive a power-on detection signal according to a power source signal of a switch;

the power source signal is configured to transmit to a polycrystalline silicon; the polycrystalline silicon is configured to undergo rectification; a post-rectification stable voltage is configured to be available at a specific rated value; an actual numerical signal of voltage is configured to be output; the power source signal, a rated voltage and a wave mode are configured to be adjusted and output through a controllable module.

4. The wide voltage steam electric iron according to claim 3, wherein the rated voltage and the wave mode are configured to output a stable signal; and the stable signal is configured to transmit to a chip and the PCB to control a water pump, the heating cavity, and a resistance wire.

* * * * *